US006120726A

United States Patent [19]

Eggert et al.

[11] Patent Number: 6,120,726

[45] Date of Patent: Sep. 19, 2000

[54] AUTOMATIC TAPPING THIMBLE

[75] Inventors: Horst Eggert, Dorsten; Michael Steinhorst, Essen, both of Germany

[73] Assignee: Elektro-Thermit GmbH, Essen, Germany

[21] Appl. No.: 09/178,146

[22] Filed: Oct. 23, 1998

[30] Foreign Application Priority Data

Oct. 31, 1997 [DE] Germany ..... 197 48 165

[51] Int. Cl.[7] ..... C21B 7/12

[52] U.S. Cl. ..... 266/45; 266/236; 266/271; 222/590; 222/597

[58] Field of Search ..... 266/45, 230, 236, 266/271; 222/590, 591, 597

[56] References Cited

U.S. PATENT DOCUMENTS

| | | | |
|---|---|---|---|
| 3,831,915 | 8/1974 | Guntermann | 266/236 |
| 4,149,704 | 4/1979 | de Savigny | 266/271 |
| 4,522,322 | 6/1985 | Guntermann et al. | 222/597 |
| 5,164,098 | 11/1992 | Brown et al. | 222/590 |
| 5,718,415 | 2/1998 | Dainton | 266/45 |

FOREIGN PATENT DOCUMENTS

| | | |
|---|---|---|
| 3211831 C2 | 10/1983 | Germany . |
| WO 80/00546 | 4/1980 | WIPO . |

*Primary Examiner*—Scott Kastler
*Attorney, Agent, or Firm*—Brown & Wood, LLP

[57] ABSTRACT

The invention relates to an automatically opening tapping thimble made from a refractory material for casting crucibles which are used in aluminothermic reactions. This thimble consists entirely or partially of air-permeable graphite or metal whose melting point lies between 2100 and 3727° C.

15 Claims, 4 Drawing Sheets

AUTOMATIC TAPPING THIMBLE

FIELD OF THE INVENTION

The invention relates to an automatically tapping closure made from a refractory material for casting crucibles which are used in aluminothermic reactions.

BACKGROUND OF THE INVENTION

Aluminothermic reactions are usually carried out in a conical crucible, in the narrowed lower region of which an outlet nozzle is exchangeably arranged. The outlet nozzle must be closed while the aluminothermic reaction is being carried out.

The molten metal which is formed during the aluminothermic reaction may only flow out of the outlet nozzle when the molten liquid slag, essentially comprising aluminum oxide, has separated from the molten metal and is floating thereon. If the outlet nozzle is tapped too early, there is a risk of incorrect casting owing to the reaction of the aluminothermic mixture being as yet incomplete or as a result of the separation between the aluminum oxide slag formed and the molten metal formed not yet being complete.

In order to increase the welding reliability, closures for the outlet nozzle are known which begin to melt and are melted through by the molten metal produced aluminothermically within a predetermined time.

For example, DE-C-32 11 831 describes a device for the automatic casting of aluminothermically produced steel, which device is composed of various small ceramic plates and an aluminum sleeve. This device is inserted into the outlet of the reaction crucible and serves as an automatically tapping closure, i.e. the closure melts through at a specific time and the outlet opens automatically without the intervention of a person, so that the liquid steel produced can flow out of the reaction crucible. This device is also known as an automatic tapping thimble.

Such an automatic tapping thimble usually comprises a Plug body, for example made from sand, a sleeve, for example made from aluminum, and one or more small closure plates, for example made from compressible fibrous aluminum silicate.

The material used to produce these closure disks has a melting point of ≧1650° C. A preferred range indicated has a melting point of 1700° C. ±20° C.

WO 80/00546 describes a method for controlling the discharge from a tundish during the continuous casting of steel. In this method, first of all the outlet opening of the tundish is covered with a cover which consists of graphite, silicon or a combination of these elements.

This publication does not go into any detail with regard to the importance of the casting temperature or with regard to the temperature which is reached locally during the strongly exothermic thermite reaction, which can quite easily exceed the casting temperature.

It is even noted that penetration of the graphite by the steel is to be avoided.

The thermite reaction can be divided into two steps, the reduction reaction and the separation between Thermit steel and slag. Normally, each of these steps lasts on average about 10 seconds.

Then, the Thermit steel is available after approx. 10 seconds. This state corresponds to the tundish filled with steel during the continuous casting of steel. If, in the thermite reaction, the molten metal is discharged at the time described in WO 80/00546, i.e. only after up to 40 seconds after the liquid Thermit steel has become available, there is a risk of blocked tap, i.e. of the Thermit steel solidifying prematurely in the reaction crucible.

In order to achieve a homogeneous reaction product, it is necessary for the aluminothermic reaction to proceed as uniformly as possible and for this uniform reaction progress to be reproducible. If the reactions proceed at different rates, the alloy-forming ingredients may be burned off differently. This leads to alloys of different compositions and hence also to different properties.

If the reaction is carried out in a casting crucible, the bottom opening of which is sealed off by a thimble which can be melted through, as described, for example, in DE-C-32 11 831, it is intended that the thimble should be melted through within a precisely predetermined time interval after ignition of the mixture, in order to ensure that the reaction has ended and the slag has completely separated from the molten metal. If the thimble were to melt through too early, liquid slag particles which have not yet separated out could be entrained by the molten metal flowing out. If the thimble were to melt through too late, the melt may have already been cooled excessively and may therefore be in a state which is undesirable in particular during rail welding.

The cooling of the molten steel in the reaction crucible is combined with a cooling of the rail. The longer the tapping times, the more the rail cools down, thus making it more difficult to weld.

The residence time of the molten steel in the reaction crucible is therefore an important parameter for the welding of rails. The more uniform the opening times, also known as tapping times, of the automatic tapping thimble are, the more reproducible the welding conditions become, which simultaneously brings about a higher welding reliability.

Since ceramic fibers or other suitable fibrous materials which have a not inconsiderable compressibility are generally used in the automatic tapping thimbles according to the prior art, the tapping times are also affected to a considerable extent by the compression of these fibrous materials during the manufacture of the crucible plugs.

The use of the tapping thimbles of the prior art therefore leads to great fluctuations in the discharge times, which again has an adverse effect on the welding conditions and consequently also on the welding reliability.

BRIEF SUMMARY OF THE INVENTION

The invention is therefore based on the object of providing an aluminothermic device which ensures that aluminothermically produced steel is cast at a time which is as early as possible and is specifically defined, in order to avoid undesirable slag particles being entrained. The invention is based on the further object of finding a material which fulfills the abovementioned demands and is also as incompressible as possible.

This object is achieved according to the invention by means of an automatically tapping thimble which consists entirely or partially of air-permeable graphite or metals whose melting points lie between 2100 and 3727° C.

The thimble is made of material which has a melting point above the temperature of the molten steel to be discharged from the crucible, and which upon contacting the molten steel forms an alloy or other composition whose melting point is below the temperature of the molten steel to be discharged.

Another aspect of the invention is a crucible for holding and discharging molten steel, such as aluminothermically produced steel, the crucible having an outlet for discharging molten steel therethrough, wherein the outlet is closed with a thimble made of the aforesaid material.

A further aspect of the invention is the method of discharging molten steel from a crucible, comprising providing said molten steel in a crucible having an outlet as aforesaid for a sufficient time that said molten steel forms with said thimble material an alloy or other composition having a melting point less than the temperature of said molten steel whereupon said thimble melts and said molten steel flows through the outlet.

DETAILED DESCRIPTION OF THE INVENTION

Preferably, the material of the thimble consists of permeable graphite; porous graphite is particularly suitable, since penetration is desirable.

In the case of compact graphite, one or more bores with a diameter of 0.1 to 2 mm are to be present. The thickness of the permeable graphite is 0.2 to 15 mm. The density is 0.8 to 2.25 g/cm$^3$.

Furthermore, it is possible to use refractory metals, such as niobium, tantalum, molybdenum, tungsten or hafnium, which have a thickness of from 0.2 to 20 mm and have one or more bores with a diameter of 0.1 to 2 mm present.

The bores are therefore introduced into the small metal disks, so that included air can escape during the reaction and there is no risk of so-called block casting, which means that the molten steel is prevented from being discharged as a result of the formation of an air cushion.

It was surprising that a material with such a high melting point can be used. Only when it forms a composition such as an alloy with the liquid Thermit steel are compounds formed whose melting points lie below the outlet temperature of the liquid steel. This sequence is to be explained in more detail as follows:

$$Tm1>TA$$

and $$TA>Tm2>Tm$$

Tm: melting point of the aluminothermically produced steel

Tm1: melting point of the closure material of the automatic crucible plug

Tm2: melting point of the compound or alloy composition formed from the closure material and the aluminothermically produced steel TA: Temperature of the aluminothermically produced steel when it is being discharged Owing to the use of these small, incompressible closure disks, the reproducibility of the crucible tapping time has been increased by comparison with tapping thimbles of the prior art, i.e. the prescribed tapping times are observed accordingly.

The tapping thimbles according to the invention are explained in more detail with reference to FIGS. 1 to 4.

Figure 1:
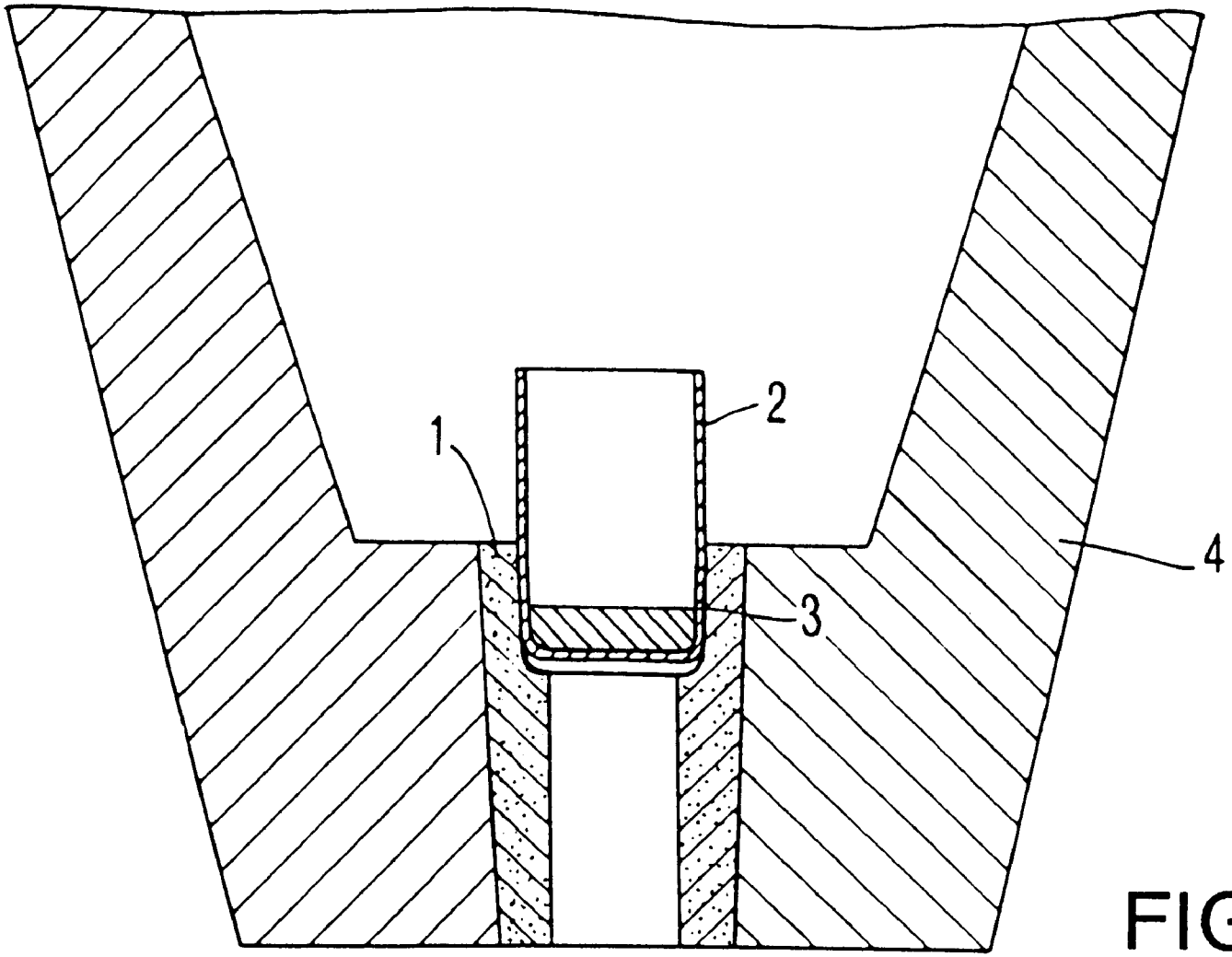
FIGS. 1, 2, 3 and 4 are cross-sectional views of a crucible having a bottom tap, and showing tapping thimbles according to the invention in place in the tap.

FIG. 1 shows one or more small tapping disks 3 made from graphite and sleeve 2, which is also made from graphite. The thimble body 1 is made of sand and is inserted in a form-fitting manner into the crucible 4.

Figure 2:
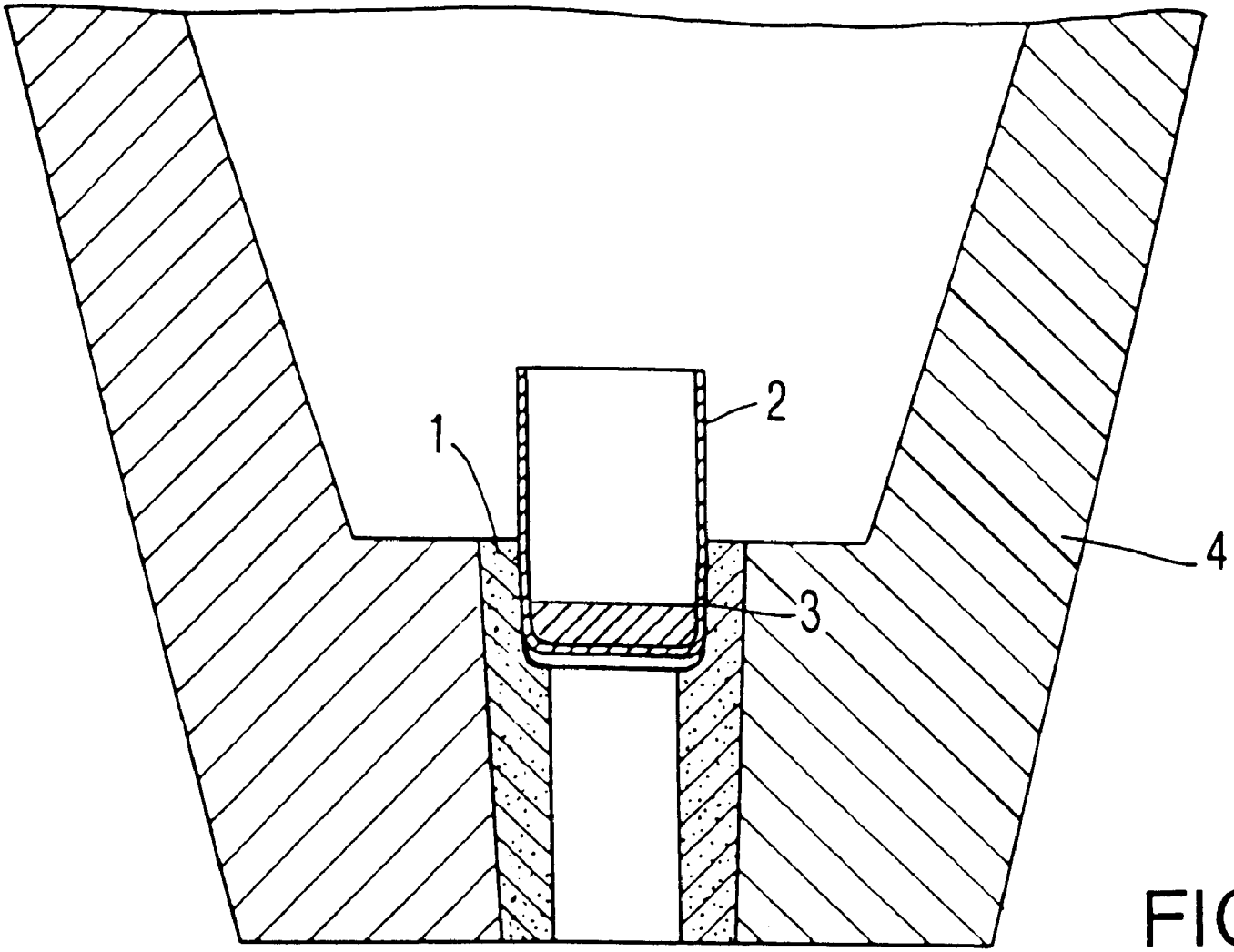

FIG. 2 shows sleeve 2 and small plate 3 made from graphite, the thimble body 1 also being formed from graphite.

Figure 3:
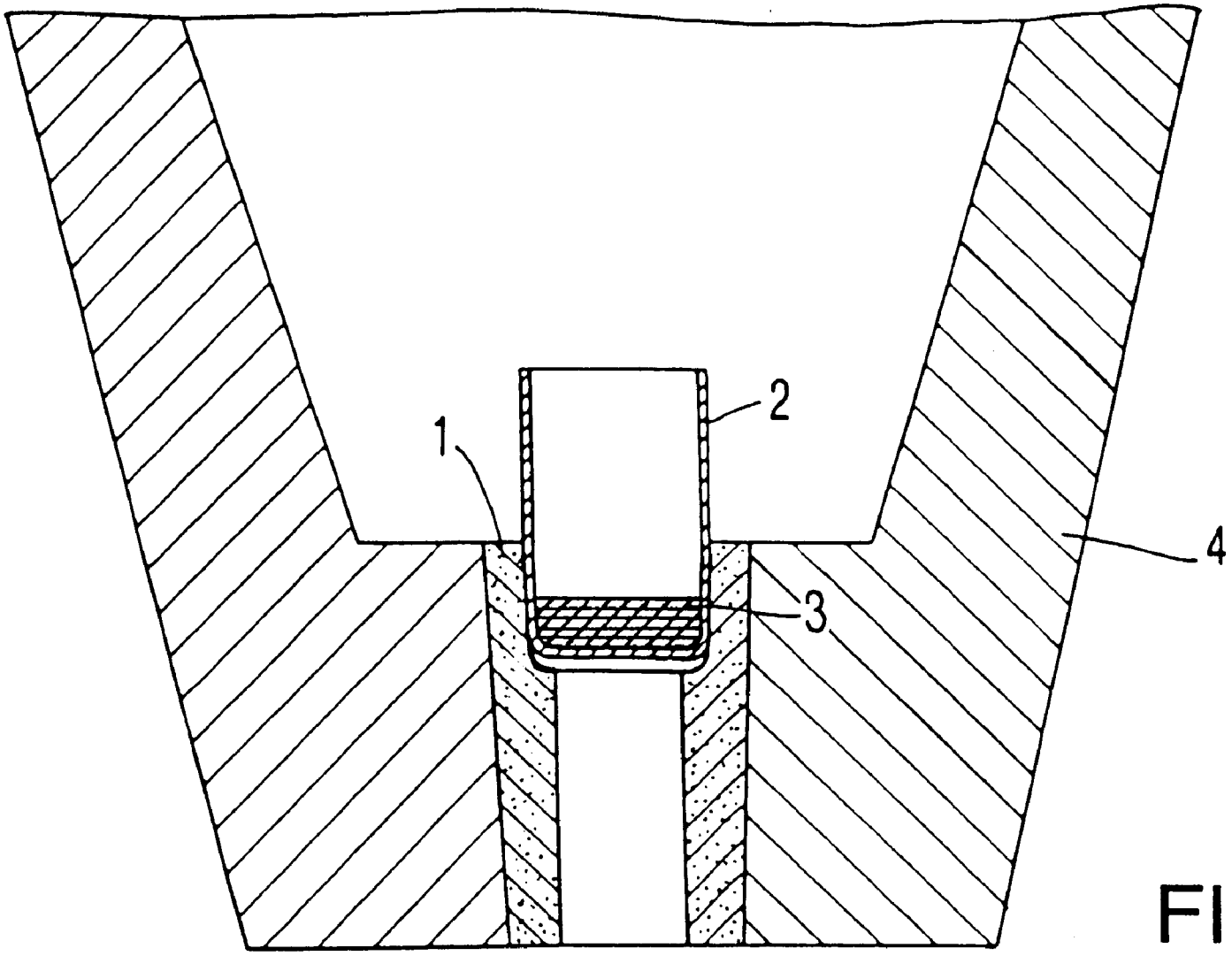

In FIG. 3, the thimble body 1 is made of sand, while sleeve 2 and tapping disks 3 consist of graphite.

Figure 4:
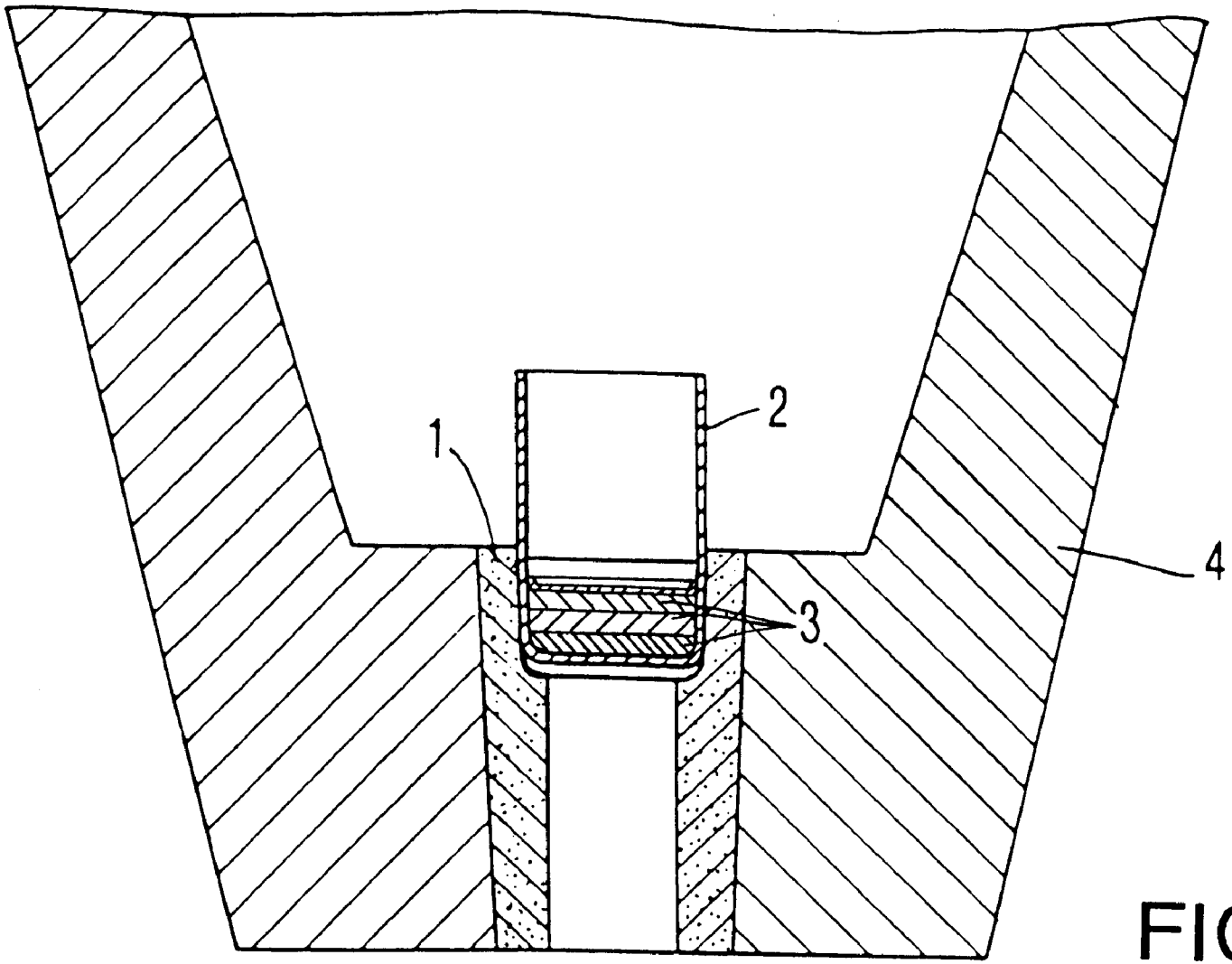

FIG. 4 shows fibrous ceramic tapping disks 3 in accordance with the prior art, the sleeve 2 consisting of aluminum and the thimble body 1 of sand.

What is claimed is:

1. An automatically opening tapping thimble made from a refractory material for casting crucibles which are used in aluminothermic reactions, wherein the thimble consists of an annular thimble body with an upper end and a lower end and an orifice therethrough; an annular sleeve with an open upper end and a closed lower end where the lower end of the sleeve is located within the orifice and below the upper end of the thimble body, and the sleeve upper end is located above the upper end of the thimble body; and at least one closure disk located within the sleeve adjacent the lower end of the sleeve, where the thimble consists of an entirely or partially of air-permeable graphite or metal whose melting point lies between 2100 and 3727° C.

2. A crucible for holding and discharging molten steel, comprising an outlet for discharging the molten steel therethrough; and an automatically opening tapping thimble for closing the outlet and made from a refractory material for casting crucibles which are used in aluminothermic reactions, wherein the thimble consists of an annular thimble body with an upper end and a lower end and an orifice therethrough; an annular sleeve with an open upper end and a closed lower end where the lower end of the sleeve is located within the orifice and below the upper end of the thimble body, and the sleeve upper end is located above the upper end of the thimble body; and at least one closure disk located within the sleeve adjacent the lower end of the sleeve, where the thimble consists of an entirely or partially of air-permeable graphite or metal whose melting point lies between 2100 and 3727° C.

3. A method of discharging molten steel from a crucible having an outlet for discharging the molten steel therethrough, the method comprising the steps of forming an automatically opening tapping thimble for closing the outlet and made from a refractory material for casting crucibles which are used in aluminothermic reactions, wherein the thimble consists of an annular thimble body with an upper end and a lower end and an orifice therethrough; an annular sleeve with an open upper end and a closed lower end where the lower end of the sleeve is located within the orifice and below the upper end of the thimble body, and the sleeve upper end is located above the upper end of the thimble body; and at least one closure disk located within the sleeve adjacent the lower end of the sleeve, where the thimble consists of an entirely or partially of air-permeable graphite or metal whose melting point lies between 2100 and 3727° C.; and closing the crucible outlet with the thimble, whereby upon a contact of the thimble with the molten steel having a temperature below the melting point of the thimble, a composition is formed the melting point of which is below the temperature of the molten steel to be discharged so that substantially the entire thimble melts enabling flow of the molten steel through the crucible outlet.

4. The thimble as claimed in claim 1, which consists entirely or partially of porous graphite and has a thickness of between 0.2 and 15 mm and a density of from 0.8 to 2.0 g/cm$^3$.

5. The thimble as claimed in claim 1, which consists entirely or partially of compact graphite, has a thickness of between 0.2 and 15 mm and a density of from 2.0 to 2.25 g/cm$^3$ and has one or more bores with a diameter of 0.1 to 2 mm.

6. The thimble as claimed in claim 1, which consists entirely or partially of the metals niobium, tantalum, molybdenum, tungsten or hafnium, has a thickness of from 0.2 to 20 mm and has one or more bores with a diameter of from 0.1 to 2 mm.

7. The thimble as claimed in claim 6 which has a thickness of from 0.5 to 15 mm and bores with a diameter of from 0.4 to 1 mm.

8. The crucible as claimed in claim 2, wherein said thimble consists entirely or partially of porous graphite and has a thickness of between 0.2 and 15 mm and a density of from 0.8 to 2.0 g/cm$^3$.

9. The crucible as claimed in claim 2, wherein said thimble consists entirely or partially of compact graphite, has a thickness of between 0.2 and 15 mm and a density of from 2.0 to 2.25 g/cm$^3$ and has one or more bores with a diameter of 0.1 to 2 mm.

10. The crucible as claimed in claim 2, wherein said thimble consists entirely or partially of metal selected from the group consisting of niobium, tantalum, molybdenum, tungsten and hafnium, has a thickness of from 0.2 to 20 mm and has one or more bores with a diameter of from 0.1 to 2 mm.

11. The crucible as claimed in claim 10 wherein said thimble has a thickness of from 0.5 to 15 mm and bores with a diameter of from 0.4 to 1 mm.

12. The method as claimed in claim 3 wherein said thimble consists entirely or partially of porous graphite and has a thickness of between 0.2 and 15 mm and a density of from 0.8 to 2.0 g/cm$^3$.

13. The method as claimed in claim 3, wherein said thimble consists entirely or partially of compact graphite, has a thickness of between 0.2 and 15 mm and a density of from 2.0 to 2.25 g/cm$^3$ and has one or more bores with a diameter of 0.1 to 2 mm.

14. The method as claimed in claim 3 wherein said thimble consists entirely or partially of metal selected from the group consisting of niobium, tantalum, molybdenum, tungsten and hafnium, has a thickness of from 0.2 to 20 mm and has one or more bores with a diameter of from 0.1 to 2 mm.

15. The method as claimed in claim 14 wherein said thimble has a thickness of from 0.5 to 15 mm and bores with a diameter of from 0.4 to 1 mm.

* * * * *